US006243672B1

(12) United States Patent
Iijima et al.

(10) Patent No.: US 6,243,672 B1
(45) **Date of Patent: *Jun. 5, 2001**

(54) SPEECH ENCODING/DECODING METHOD AND APPARATUS USING A PITCH RELIABILITY MEASURE

(75) Inventors: Kazuyuki Iijima, Saitama; Masayuki Nishiguchi; Jun Matsumoto, both of Kanagawa, all of (JP)

(73) Assignee: Sony Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/927,895

(22) Filed: Sep. 11, 1997

(30) Foreign Application Priority Data

Sep. 27, 1996 (JP) ..... 8-257128

(51) Int. Cl.[7] ..... G10L 11/04
(52) U.S. Cl. ..... 704/207; 704/217
(58) Field of Search ..... 704/207, 208, 704/217, 214

(56) References Cited

U.S. PATENT DOCUMENTS 4,809,334 * 2/1989 Bhaskar ..... 381/49
5,226,108 * 7/1993 Hardwick et al. ..... 704/207
5,699,477 * 12/1997 McCree ..... 704/207
5,704,000 * 12/1997 Swaminathan et al. ..... 704/207
5,745,871 * 4/1998 Chen ..... 704/207
5,765,125 * 6/1998 Daugherty et al. ..... 704/205
5,774,836 * 6/1998 Bartkowiak et al. ..... 704/216
5,826,222 * 10/1998 Griffin ..... 704/208

FOREIGN PATENT DOCUMENTS 0266868 5/1988 (EP) .
0280827 9/1988 (EP) .
0333121 9/1989 (EP) .

* cited by examiner

*Primary Examiner*—William R. Korzuch
*Assistant Examiner*—Harold Zintel
(74) *Attorney, Agent, or Firm*—Jay H. Maioli

(57) ABSTRACT

A pitch detection method and apparatus capable of realizing high-precision pitch detection even for speech signals in which half-pitch or double-pitch exhibits stronger autocorrelation than the pitch for detection. An input speech signal is judged as to voicedness or unvoicedness and a voiced portion and an unvoiced portion of the input speech signal are encoded by a sinusoidal analytic encoding unit 114 and by a code excitation encoding unit 120, respectively, for producing respective encoded outputs. The sinusoidal analytic encoding unit 114 performs pitch search on the encoded outputs for finding the pitch information from the input speech signal and sets the high-reliability pitch information based on the detected pitch information. The results of pitch detection are determined based on the high-reliability pitch information.

5 Claims, 10 Drawing Sheets

| | 2Kbps | | 6Kbps | |
|---|---|---|---|---|
| V/UV DECISION OUTPUT | 1bit / 20msec | | 1bit / 20msec | |
| LSP QUANTIZATION INDEX | 32bits / 40msec | | 48bits / 40msec | |
| FOR VOICED SOUND (V) | PITCH DATA | 8bits / 20msec | PITCH DATA | 8bits / 20msec |
| | INDEX 15bits / 20msec | | INDEX 87bits / 20msec | |
| | SHAPE (FIRST STAGE)<br>GAIN | 5+5bits / 20msec<br>5bits / 20msec | SHAPE (FIRST STAGE)<br>GAIN<br>INDEX (SECOND STAGE) | 5+5bits / 20msec<br>5bits / 20msec<br>72bits / 20msec |
| FOR UNVOICED SOUND (UV) | INDEX 11bits / 10msec | | INDEX 23bits / 5msec | |
| | SHAPE (FIRST STAGE)<br>GAIN | 7bits / 10msec<br>4bits / 10msec | SHAPE (FIRST STAGE)<br>GAIN<br>SHAPE (SECOND STAGE)<br>GAIN | 9bits / 5msec<br>6bits / 5msec<br>5bits / 5msec<br>3bits / 5msec |
| FOR VOICED SOUND<br>FOR UNVOICED SOUND | 40bits / 20msec<br>39bits / 20msec | | 120bits / 20msec<br>117bits / 20msec | |

FIG.6

SPEECH ENCODING/DECODING METHOD AND APPARATUS USING A PITCH RELIABILITY MEASURE

BACKGROUND OF THE INVENTION

Field of the Invention

This invention relates to a speech encoding method and apparatus in which an input speech signal is split on the time axis in terms of a pre-set block as an encoding unit and encoded from one such encoding unit to another. The invention also relates to a pitch detection method employing the speech encoding method and apparatus.

Description of the Related Art

Up to now, there are known a variety of encoding methods for performing signal compression by exploiting statistic properties in the time domain and frequency domain of audio signals, inclusive of speech and acoustic signals, and psychoacoustic properties of the human being. These encoding method are roughly classified into encoding in the time domain, encoding in the frequency domain and analysis-synthesis encoding.

Among the techniques for high-efficiency encoding of speech signals are sinusoidal analysis encoding, such as harmonic encoding or multi-band excitation (MBE) encoding, sub-band coding (SBC), linear predictive coding (LPC), discrete cosine transform (DCT), modified DCT (MDCT) and fast Fourier transform (FFT).

Meanwhile, in the sinusoidal synthetic encoding generating excitation signals using the pitch of an input speech signal as a parameter, pitch detection plays an important role. With a pitch detection method employing an autocorrelation method used in a conventional speech signal encoding circuit and which is seasoned with a fractional search with the sample shifting of not more than one sample for improving pitch detection accuracy, if the half-pitch or the double pitch exhibits stronger correlation than the pitch desired to be detected in the speech signal, pitch detection tends to result in failure.

SUMMARY OF THE INVENTION

It is therefore an object of the present invention to provide a pitch detection method capable of correctly detecting the pitch for a speech signal in which the half-pitch or the double pitch exhibits stronger correlation than the pitch desired to be detected in the speech signal.

It is another object of the present invention to provide a speech signal encoding method and apparatus capable of producing a highly clear natural playback speech devoid of extraneous noise by application of the above-mentioned pitch detection method.

The present invention provides a pitch detection method in which an input speech signal is divided on the time axis in terms of pre-set encoding units for detecting the pitch corresponding to the fundamental period of the encoding-unit-based speech signal. The method includes a pitch searching step of detecting the pitch information under a pre-set pitch detection condition, a step of setting the high-reliability pitch information satisfying a condition which becomes true if the likeliness to pitch is higher than under the pitch detecting condition based on the detected pitch information, speech level of the input speech signal and on the autocorrelation peak value of the input speech signal, and a step of determining the pitch based on the set high-reliability pitch information.

The pitch detection method according to the present invention permits high-precision pitch detection without mistaken detection of the half-pitch or the double-pitch.

The present invention also provides a speech signal encoding method and device in which an input speech signal is divided on the time axis in terms of a pre-set encoding unit and encoded on the encoding unit basis. The encoding method and device include predicting encoding of detecting the pitch by the above-defined pitch detection method for finding short-term prediction residuals of the input speech signals, sinusoidal analytic encoding of performing sinusoidal analytic encoding on the short-term prediction residuals thus found, waveform analysis encoding of performing waveform analysis encoding on the input speech signals and judgment of the voicedness/unvoicedness of the input speech signals.

With the above-described speech encoding method and device according to the present invention, pitch detection can be performed without mistaken detection of the half-pitch or double-pitch in the speech signals, thus enabling explosives or fricatives, such as p, k or t, to be reproduced clearly, while there is produced no extraneous sound in a transition portion between the voiced and unvoiced portions, thus assuring reproduction of the clear natural speech devoid of buzzing.

BRIEF DESCRIPTION OF THE DRAWINGS

FIG. 6 is a table showing data of various but rates.

DESCRIPTION OF THE PREFERRED EMBODIMENTS

Figure 1:
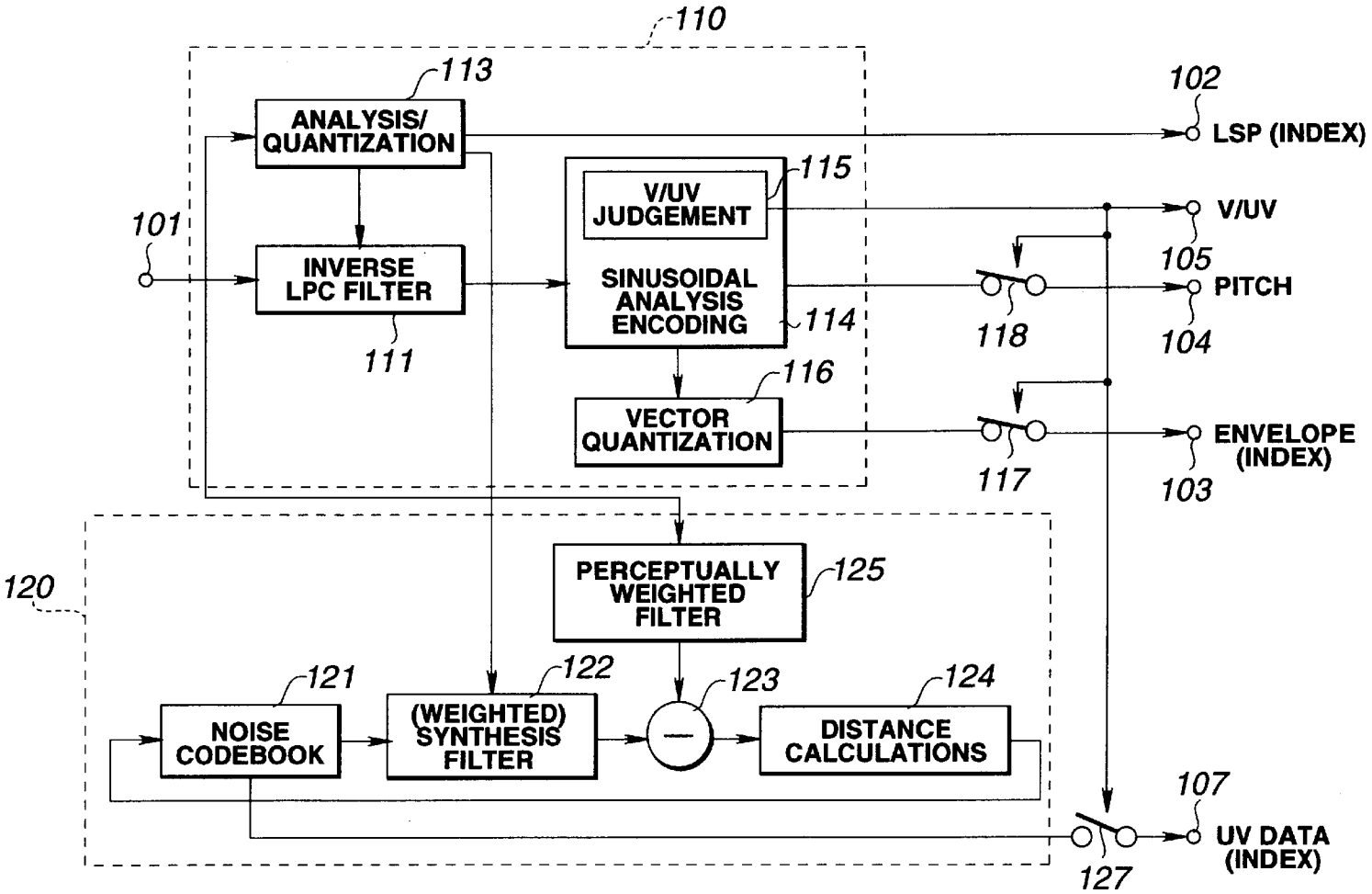
FIG. 1 is a block diagram showing the basic structure of a speech encoding device for carrying out the speech encoding method according to the present invention.

Referring to the drawings, preferred embodiments of the present invention will be explained in detail.

FIG. 1 shows the basic structure of an encoding device for implementing the pitch detection method and the speech signal encoding method embodying the present invention.

The basic concept underlying the speech signal encoding of FIG. 1 is that the encoding device has a first encoding unit 110 for finding short-term prediction residuals, such as linear prediction encoding (LPC) residuals, of the input speech signal, in order to effect sinusoidal analysis encoding, such as harmonic coding, and a second encoding unit 120 for encoding the input speech signal by waveform encoding having phase reproducibility, and that the first encoding unit 110 and the second encoding unit 120 are used for encoding the voiced (V) speech of the input signal and for encoding the unvoiced (UV) portion of the input signal, respectively.

The first encoding unit 110 employs a constitution of encoding, for example, the LPC residuals, with sinusoidal analytic encoding, such as harmonic encoding or multi-band excitation (MBE) encoding. The second encoding unit 120 employs a constitution of carrying out code excited linear prediction (CELP) using vector quantization by closed loop search of an optimum vector by closed loop search and also using, for example, an analysis by synthesis method.

In an embodiment shown in FIG. 1, the speech signal supplied to an input terminal 101 is sent to an LPC inverted filter 111 and an LPC analysis and quantization unit 113 of the first encoding unit 110. The LPC coefficients or the so-called α-parameters, obtained by an LPC analysis quantization unit 113, are sent to the LPC inverted filter 111 of the first encoding unit 110. From the LPC inverted filter 111 are taken out linear prediction residuals (LPC residuals) of the input speech signal. From the LPC analysis quantization unit 113, a quantized output of linear spectral pairs (LSPs) are taken out and sent to an output terminal 102, as later explained. The LPC residuals from the LPC inverted filter 111 are sent to a sinusoidal analytic encoding unit 114. The sinusoidal analytic encoding unit 114 performs pitch detection and calculations of the amplitude of the spectral envelope while performing V/UV discrimination. The spectra envelope amplitude data from the sinusoidal analytic encoding unit 114 is sent to a vector quantization unit 116. The codebook index from the vector quantization unit 116, as a vector-quantized output of the spectral envelope, is sent via a switch 117 to an output terminal 103, while an output of the sinusoidal analytic encoding unit 114 is sent via a switch 118 to an output terminal 104. A V/UV discrimination output of a V/UV discrimination unit 115 is sent to an output terminal 105 and, as a control signal, to the switches 117, 118. If the input speech signal is a voiced (V) sound, the index and the pitch are selected and taken out at the output terminals 103, 104, respectively.

The second encoding unit 120 of FIG. 1 has, in the present embodiment, a code excited linear prediction coding (CELP coding) configuration, and vector-quantizes the time-domain waveform using a closed loop search employing an analysis by synthesis method in which an output of a noise codebook 121 is synthesized by a weighted synthesis filter 122, the resulting weighted speech is sent to a subtractor 123, an error between the weighted speech and the speech signal supplied to the input terminal 101 and thence through a perceptually weighting filter 125 is taken out, the error thus found is sent to a distance calculation circuit 124 to effect distance calculations and a vector minimizing the error is searched by the noise codebook 121. This CELP encoding is used for encoding the unvoiced speech portion, as explained previously. The codebook index, as the UV data from the noise codebook 121, is taken out at an output terminal 107 via a switch 127 which is turned on when the result of V/UV decision from the V/UV discrimination 115 specifies the unvoiced (UV) sound.

Figure 2:
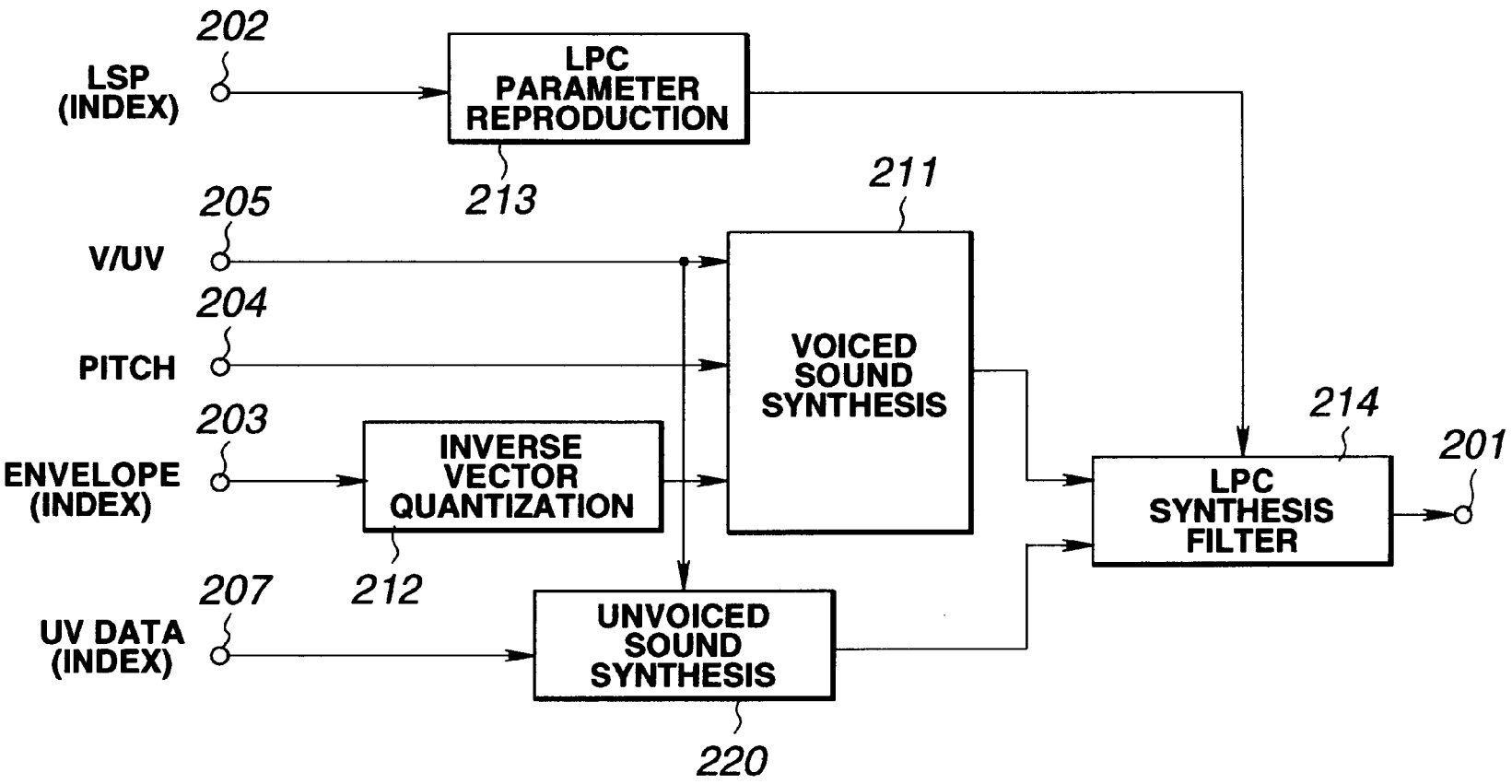
FIG. 2 is a block diagram showing the basic structure of a speech decoding device for carrying out the speech decoding method according to the present invention.

FIG. 2 is a block diagram showing the basic structure of a speech signal decoding device, as a counterpart device of the speech signal encoder of FIG. 1, for carrying out the speech decoding method according to the present invention.

Referring to FIG. 2, a codebook index as a quantization output of the linear spectral pairs (LSPs) from an output terminal 102 of FIG. 1 is supplied to an input terminal 202. To input terminals 203, 204 and 205 are entered outputs of the output terminals 103, 104 and 105 of FIG. 1, respectively, that is index, as the output of envelope quantization, pitch and the V/UV decision results, respectively. To the input terminal 207 is entered an index as data for unvoiced (UV) speech from the output terminal 107.

The index as the envelope quantization output of the input terminal 203 is sent to an inverse vector quantization unit 212 for inverse vector quantization to find a spectral envelope of the LPC residues which is sent to a voiced speech synthesizer 211. The voiced speech synthesizer 211 synthesizes the linear prediction encoding (LPC) residuals of the voiced speech portion by sinusoidal synthesis. The synthesizer 211 is fed also with the pitch and the results of V/UV decision from the input terminals 204, 205. The LPC residuals of the voiced speech from the voiced speech synthesis unit 211 are sent to an LPC synthesis filter 214. The index data of the UV data from the input terminal 207 is sent to an unvoiced sound synthesis unit 220 where reference is had to the noise codebook for taking out the LPC residuals of the unvoiced portion. These LPC residuals are also sent to the LPC synthesis filter 214. In the LPC synthesis filter 214, the LPC residuals of the voiced portion and the LPC residuals of the unvoiced portion are independently processed by LPC synthesis. Alternatively, the LPC residuals of the voided portion and the LPC residuals of the unvoiced portion summed together may be processed with LPC synthesis. The LSP index data from the input terminal 202 is sent to the LPC parameter reproducing unit 213 where α-parameters of the LPC are taken out and sent to the LPC synthesis filter 214. The speech signals synthesized by the LPC synthesis filter 214 are taken out at an output terminal 201.

Figure 3:
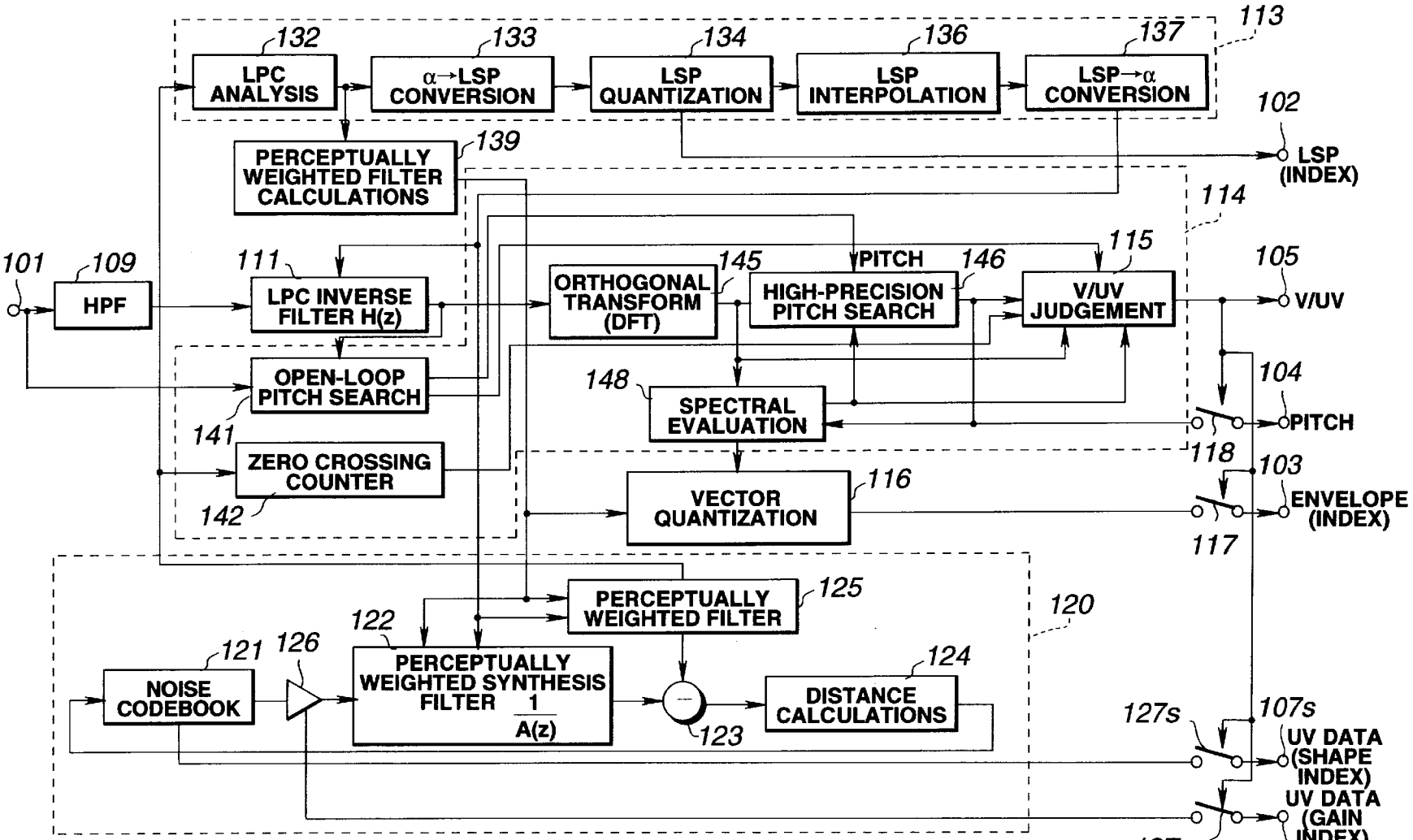
FIG. 3 is a block diagram showing a more specified structure of a speech encoding device embodying the present invention.

Referring to FIG. 3, a more detailed structure of a speech signal encoder shown in FIG. 1 is now explained. In FIG. 3, the parts or components similar to those shown in FIG. 1 are denoted by the same reference numerals.

In the speech signal encoder shown in FIG. 3, the speech signals supplied to the input terminal 101 are filtered by a high-pass filter HPF 109 for removing signals of an unneeded range and thence supplied to an LPC (linear prediction encoding) analysis circuit 132 of the LPC analysis/quantization unit 113 and to the inverted LPC filter 111.

The LPC analysis circuit 132 of the LPC analysis/quantization unit 113 applies a Hamming window, with a length of the input signal waveform on the order of 256 samples as a block, and finds a linear prediction coefficient, that is a so-called α-parameter, by the autocorrelation method. The framing interval as a data outputting unit is set to approximately 160 samples. If the sampling frequency $f_s$ is 8 kHz, for example, a one-frame interval is 20 msec or 160 samples.

The α-parameter from the LPC analysis circuit 132 is sent to an α-LSP conversion circuit 133 for conversion into line spectrum pair (LSP) parameters. This converts the α-parameter, as found by direct type filter coefficient, into for example, ten, that is five pairs of the LSP parameters. This conversion is carried out by, for example, the Newton-Rhapson method. The reason the α-parameters are converted into the LSP parameters is that the LSP parameter is superior in interpolation characteristics to the α-parameters.

The LSP parameters from the α-LSP conversion circuit 133 are matrix- or vector quantized by the LSP quantizer 134. It is possible to take a frame-to-frame difference prior to vector quantization, or to collect plural frames in order to perform matrix quantization thereon. In the present case, two frames, each 20 msec long, of the LSP parameters, calculated every 20 msec, are handled together and processed with matrix quantization and vector quantization.

The quantized output of the quantizer 134, that is the index data of the LSP quantization, are taken out at a terminal 102, while the quantized LSP vector is sent to an LSP interpolation circuit 136.

The LSP interpolation circuit 136 interpolates the LSP vectors, quantized every 20 msec or 40 msec, in order to provide an octatuple rate. That is, the LSP vector is updated every 2.5 msec. The reason is that, if the residual waveform is processed with the analysis by synthesis by the harmonic encoding/decoding method, the envelope of the synthetic waveform presents an extremely smooth waveform, so that, if the LPC coefficients are changed abruptly every 20 msec, an extraneous noise is likely to be produced. That is, if the LPC coefficient is changed gradually every 2.5 msec, such extraneous noise may be prevented from occuring.

For inverted filtering of the input speech using the interpolated LSP vectors produced every 2.5 msec, the LSP parameters are converted by an LSP to α conversion circuit 137 into α-parameters, which are filter coefficients of e.g., ten-order direct type filter. An output of the LSP to α conversion circuit 137 is sent to the LPC inverted filter circuit 111 which then performs inverse filtering for producing a smooth output using an α-parameter updated every 2.5 msec. An output of the inverse LPC filter 111 is sent to an orthogonal transform circuit 145, such as a DCT circuit, of the sinusoidal analysis encoding unit 114, such as a harmonic encoding circuit.

The α-parameter from the LPC analysis circuit 132 of the LPC analysis/quantization unit 113 is sent to a perceptual weighting filter calculating circuit 139 where data for perceptual weighting is found. These weighting data are sent to a perceptual weighting vector quantizer 116, perceptual weighting filter 125 and to the perceptual weighted synthesis filter 122 of the second encoding unit 120.

The sinusoidal analysis encoding unit 114 of the harmonic encoding circuit analyzes the output of the inverted LPC filter 111 by a method of harmonic encoding. That is, pitch detection, calculations of the amplitudes Am of the respective harmonics and voiced (V)/unvoiced (UV) discrimination, are carried out and the numbers of the amplitudes Am or the envelopes of the respective harmonics, varied with the pitch, are made constant by dimensional conversion.

In an illustrative example of the sinusoidal analysis encoding unit 114 shown in FIG. 3, commonplace harmonic encoding is used. In particular, in multi-band excitation (MBE) encoding, it is assumed in modeling that voiced portions and unvoiced portions are present in each frequency area or band at the same time point (in the same block or frame). In other harmonic encoding techniques, it is judged on the one-out-of-two basis whether the speech in one block or in one frame is voiced or unvoiced. In the following description, a given frame is judged to be UV if the totality of the bands is UV, insofar as the MBE encoding is concerned. Specified examples of the technique of the analysis synthesis method for MBE as described above may be found in JP Patent Application No.4-91442 filed in the name of the present Assignee.

The open-loop pitch search unit 141 and the zero-crossing counter 142 of the sinusoidal analysis encoding unit 114 of FIG. 3 are fed with the input speech signal from the input terminal 101 and with the signal from the high-pass filter (HPF) 109, respectively. The orthogonal transform circuit 145 of the sinusoidal analysis encoding unit 114 is supplied with LPC residuals or linear prediction residuals from the inverted LPC filter 111.

The open loop pitch search unit 141 takes the LPC residuals of the input signals to perform a 1.0 step open-loop pitch search. The extracted rough pitch data is sent to a fine pitch search unit 146 by closed loop search as later explained. The open loop pitch search unit 141 performs 0.25 step fine pitch search by the closed loop, as explained subsequently.

The open-loop pitch search unit 141 sets the high-reliability pitch information based on the extracted rough pitch information. First, candidate values of the high reliability pitch information are set under conditions more strict than those for the rough pitch information and compared to the rough pitch information for updating or discarding the irrelevant candidate values. The setting or updating the high reliability pitch information will be explained subsequently.

From the open-loop pitch search unit 141 is taken out, along with the above-mentioned rough pitch information and fine pitch information, the maximum value r'(1) of the normalized autocorrelation values obtained on normalizing the maximum value of the autocorrelation peak of the LPC residuals with the power. The maximum value r'(1), thus taken out, is sent to the voiced/unvoiced discrimination unit 115.

A decision output of the V/UV discrimination and pitch intensity information generating unit 115 as later explained may also be used as a parameter for the open-loop search described above. Only the pitch information extracted from the portion of the speech signal judged to be voiced (V) is used for the above-mentioned open-loop search.

The orthogonal transform circuit 145 performs orthogonal transform, such as discrete Fourier transform (DFT), for converting the LPC residuals on the time axis into spectral amplitude data on the frequency axis. An output of the orthogonal transform circuit 145 is sent to the fine pitch search unit 146 and a spectral evaluation unit 148 configured for evaluating the spectral amplitude or envelope.

The fine pitch search unit 146 is fed with relatively rough pitch data extracted by the open loop pitch search unit 141 and with frequency-domain data obtained by DFT by the orthogonal transform unit 145. The fine pitch search unit 146 searches for the pitch data using ± several samples, at a rate of 0.2 to 0.5 steps literation, centered about the rough pitch value data, in order to arrive ultimately at the value of the optimal fractional pitch value. The analysis by synthesis method is used as the fine search technique for selecting a pitch so that the power spectrum will be closest to the power spectrum of the original sound. The pitch data from the closed-loop fine pitch search unit 146 is sent to the spectral evaluation unit 148 and to an output terminal 104 via a switch 118.

In the spectral evaluation unit 148, the amplitude of each harmonics and the spectral envelope as a set of the harmonic are evaluated based on the spectral amplitude and the pitch as an orthogonal transform output of the LPC residuals, and are sent to the fine pitch search unit 146, V/UV discrimination unit 115 and to the perceptually weighted vector quantization unit 116.

The V/UV discrimination and pitch intensity information generating unit 115 discriminates V/UV of a frame based on an output of the orthogonal transform circuit 145, an optimum pitch from the fine pitch search unit 146, spectral amplitude data from the spectral evaluation unit 148, maximum value of the normalized self-correlation r'(1) from the open loop pitch search unit 141 and the zero-crossing count value from the zero-crossing counter 142. In addition, the boundary position of the band-based V/UV discrimination for MBE may also be used as a condition for V/UV discrimination. The V/UV discrimination output of the V/UV discrimination unit 115 is taken out at the output terminal 105.

An output unit of the spectrum evaluation unit 148 or an input unit of the vector quantization unit 116 is provided with a number of data conversion unit (a unit performing a sort of sampling rate conversion). The data number conversion unit is used for setting the amplitude data |Am| of an envelope to a pre-set constant value taking into account the fact that the number of bands split on the frequency axis and the number of data differ with the pitch. That is, if the effective band is up to 3400 kHz, the effective band can be split into 8 to 63 bands. The number of mMX+1 of the amplitude data |Am|, obtained from band to band, is changed in a range from 8 to 63. Thus the data number conversion unit 119 converts the amplitude data of the variable number mMx+1 to a pre-set number M of data, such as 44 data.

The amplitude data or envelope data of the pre-set number M, such as 44, from the data number conversion unit, provided at an output unit of the spectral evaluation unit 148 or at an input unit of the vector quantization unit 116, are gathered in terms of a pre-set number of data, such as 44 data, as units, and weighted-vector-quantized by the vector quantization unit 116. This weight is supplied by an output of the perceptual weighting filter calculation circuit 139. The index of the envelope from the vector quantizer 116 is taken out by the switch 117 at output terminal 103. Prior to weighted vector quantization, it is advisable to take inter-frame difference using a suitable leakage coefficient for a vector made up of a pre-set number of data.

The second encoding unit 120 is explained. The second encoding unit 120 is of the code excited linear prediction (CELP) coding structure and is used in particular for encoding the unvoiced portion of the input speech signal. In the CELP encoding configuration for the unvoiced speech portion, a noise output corresponding to LPC residuals of an unvoiced speech portion as a representative output of the noise codebook, that is the so-called stochastic codebook 121, is sent via gain circuit 126 to the perceptually weighted synthesis filter 122. The perceptually weighted synthesis filter 122 LPC-synthesizes the input noise to send the resulting weighted unvoiced speech signal to a subtractor 123. The speech signal supplied from the input terminal 101 via high-pass filter (HPF) 109 and perceptually weighted by the perceptually weighting filter 125 is fed to the subtractor 123 where a difference or error of the perceptually weighted speech signal from the signal from the synthesis filter 122 is found. Meanwhile, the zero-input response of the perceptually weighted synthesis filter is subtracted in advance from an output of the perceptually weighting filter 125. This error is fed to a distance calculation circuit 124 for finding the distance and a representative value vector which will minimize the error is searched by the noise codebook 121. The above is the summary of the vector quantization of the time-domain waveform employing the closed-loop search in turn employing the analysis by synthesis method.

As data for the unvoiced (UV) portion from the second encoder 120 employing the CELP coding structure, the shape index of the codebook from the noise codebook 121 and the gain index of the codebook from the gain circuit 126 are taken out. The shape index, which is the UV data from the noise codebook 121, is sent via a switch 127*s* to an output terminal 107*s*, while the gain index, which is the UV data of the gain circuit 126, is sent via a switch 127*g* to an output terminal 107*g*.

These switches 127*s*, 127*g* and the switches 117, 118 are turned on and off depending on the results of V/UV decision from the V/UV discrimination unit 115. Specifically, the switches 117, 118 are turned on, if the results of V/UV discrimination of the speech signal of the frame about to be transmitted indicates voiced (V), while the switches 127*s*, 127*g* are turned on if the speech signal of the frame about to be transmitted is unvoiced (UV).

The above-described high-reliability pitch information is explained.

The high-reliability pitch information is an evaluation parameter used in addition to the conventional pitch information for preventing mistaken detection of the double- or half-pitch. With the speech signal encoding device shown in FIG. 3, the high-reliability pitch information is set by the open-loop pitch search unit 141 of the sinusoidal analytic encoding unit 114, as a candidate value of the high-reliability pitch information, based on the input speech signal pitch information entering the input terminal 101, speech level (frame level) and the autocorrelation peak value. The candidate value of the high-reliability pitch information, thus set, is compared to the results of open-loop search of the next frame and is registered as the high-reliability pitch information if the two pitch values are sufficiently close to each other. If otherwise. The candidate value is discarded. The registered high-reliability pitch information is also discarded if it remains unupdated for a pre-set time.

The algorithm of an illustrative sequence of operations for setting and resetting the above-mentioned high-reliability pitch information is now explained with a frame as an encoding unit.

The following is the definition of variables used in the following explanation:

| | |
|---|---|
| rblPch | high-reliability pitch information |
| rblPchCd | candidate value of the high-reliability pitch information |
| rblPchHoldState | high-reliability pitch information holding time |
| lev | speech level (frame level) (rms) |

Ambiguous(p0, p1, range) is a function which becomes true if any of the following four conditions, namely $$abs(p0-2.0\times p1)/p0<\text{range}$$

$$abs(p0-3.0\times p1)/p0<\text{range}$$

$$abs(p0-p1/2.0)/p0<\text{range}$$

$$abs(p0-p1/3.0)/p0<\text{range}$$

is met, that is if two pitch values p0 and p1 are twice, thrice, one-half or one-third relative to each other. In the above inequalities, range is a pre-set constant. On the other hand, it is assumed that pitch [ ] is the rough estimate of pitch and pitch[0]: pitch of a directly previous frame pitch[1]: pitch of the current frame pitch[2]: pitch of the next oncoming (future) frame r'(n): autocorrelation peak value lag(n): pitch lag (pitch period represented by a number of samples)

where r'(n) denotes calculated values of autocorrelation $R_k$ normalized by the 0'th peak $R_0$(power) of autocorrelation and arrayed in the order of the decreasing magnitude and n denotes the order.

It is also assumed that the values of the autocorrelation peak r'(n) and the pitch lag(n) are also preserved for the current frame. These are denoted as crntR'(n) and crntLAG (n), respectively. Moreover, the following variables are defined:

rp[0]: maximum value of the autocorrelation peak of the directly previous (past) frame r'(1)

rp[1]: maximum value of the autocorrelation peak of the current frame r'[1]

rp[2]: maximum value of the autocorrelation peak of the next oncoming (future) frame r'[1]

It is further assumed that candidate pitch value of the high-reliability pitch information is set by the pitch, autocorrelation peak value or the pitch value of the current frame satisfying certain pre-set conditions and further that the high-reliability pitch information is registered only when the difference between this candidate pitch value and the pitch of the next frame is smaller than a pre-set value.

In the following, an illustrative algorithm of setting the high-reliability pitch information based on the detected rough pitch information is described below and shown in FIG. 4.

[Condition 1]

if the following conditions are met;

$$rb1Pch \times 0.6 < \text{pitch}[1] < rb1Pch \times 1.8$$

and $$rp[1] > 0.39$$

and $$lev > 200.0$$

or $$rp[1] > 0.65$$

or $$rp[1] > 0.30 \text{ and } abs(\text{pitch}[1] - rb1PchCd) < 8.0 \text{ and } lev > 400.0$$

then Condition 2 is checked, otherwise to to Processing 3;

[Condition 2]

if the following conditions are met;

$$rb1PchCd \neq 0.0 \text{ and } abs(\text{pitch}[1] - rb1PchCd) < 8$$

and !Ambiguous(rb1Pch, pitch[1], 0.11)

then proceed with Processing 1 followed by Processing 2, otherwise go directly to Processing 2.

[Processing 1]

$$rb1Pch = \text{pitch}[1]$$

endif

[Processing 2]

$$rb1PchCd = \text{pitch}[1]$$

else

[Processing 3]

$$rb1PchCd = 0.0$$

endif

Figure 4:
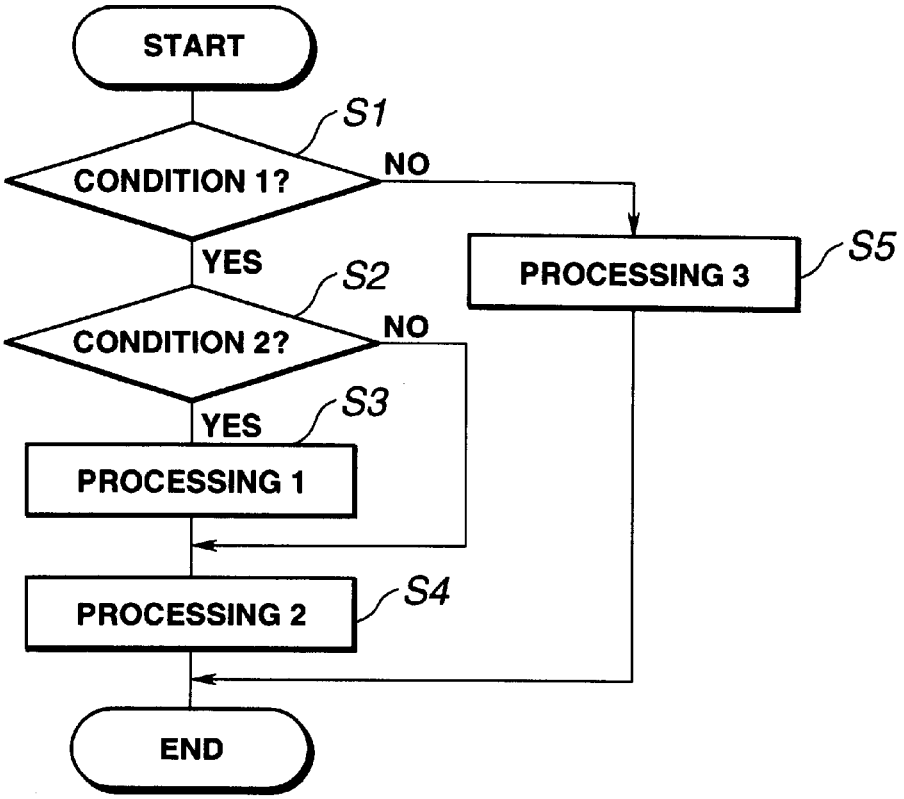
FIG. 4 is a flowchart showing the sequence of operations for setting the high-reliability pitch information.

The sequence of operations of setting the high-reliability pitch information (estimated pitch value) by the above-mentioned algorithm is explained by referring to the flowchart of FIG. 4.

If, at step S1, the 'condition1' is met, processing transfers to step S2 to judge whether or not the 'condition 2' is met. If the 'condition 1' is not met at step S1, the 'processing 3' shown in step S5 is executed, and the results of execution turn out to be the high-reliability pitch information.

If the 'condition 2' is met at step S2, 'processing 1' of step S3 is executed, followed by 'processing 2' at step S2. On the other hand, if the 'condition 2' is not met at step S2, the 'processing 1' of step S3 is not executed, but the 'processing 2' of step S4 is executed.

The results of execution of the 'processing 2' of step S4 is outputted as the high-reliability pitch information.

If, after registration of the high-reliability pitch information, the high-reliability pitch information is not newly registered for five frames on end, for example, the registered high-reliability pitch information is reset.

An example of the algorithm of resetting the high-reliability pitch information, once set, is now explained.

[Condition 3]

if $$rb1Pch\text{HoldState} = 5$$

then

[Processing 4]

$$rb1Pch = 0.0$$

$$rb1Pch\text{HoldState} = 0$$

else

[Processing 5]

$$rb1Pch\text{HoldState}{+}{+}$$

endif

Figure 5:
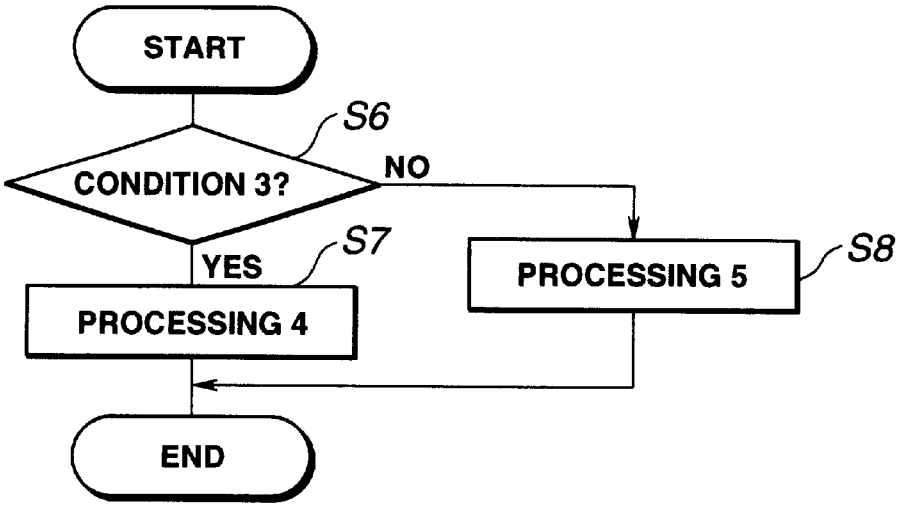
FIG. 5 is a flowchart showing the sequence of operations for resetting the high-reliability pitch information.

The sequence of operations of resetting the high-reliability pitch information by the above-mentioned algorithm is explained by referring to the flowchart of FIG. 5.

If, at step S6, the 'condition 3' is met, the 'processing 4' shown at step S7 is executed for resetting the high-reliabihty pitch information. Conversely, if the 'condition 3' is not met at step S6, the 'processing 5' shown at step S8 is executed, without the 'processing 4' of step S7 being executed, for resetting the high-reliability pitch information.

The above sets and resets the high-reliability pitch information.

The above-described speech signal encoder can output data of different bit rates depending on the demanded sound quality. That is, the output data can be outputted with a variable bit rate.

Specifically, the bit rate of output data can be switched between a low bit rate and a high bit rat rates. For example, if the low bit rate is 2 kbps and the high bit rate is 6 kbps, the output data is data having the following bit rates shown in FIG. 6.

It is noted that the pitch data from the output terminal 104 is outputted at all times at a bit rate of 8 bits/20 msec for the voiced speech, with the V/UV discrimination output from the output terminal 105 being at all times 1 bit/20 msec. The index for LSP quantization, outputted from the output terminal 102, is switched between 32 bits/40 msec and 48 bits/40 msec. On the other hand, the index during the voiced speech (V) outputted by the output terminal 103 is switched between 15 bits/20 msec and 87 bits/20 msec. The index for the unvoiced (UV) outputted from the output terminals 107*s* and 107*g* is switched between 11 bits/10 msec and 23 bits/5 msec. The output data for the voiced sound (UV) is 40 bits/20 msec for 2 kbps and 120 kbps/20 msec for 6 kbps. On the other hand, the output data for the voiced sound (UV) is 39 bits/20 msec for 2 kbps and 117 kbps/20 msec for 6 kbps. The index for LSP quantization, the index for voiced speech (V) and the index for unvoiced speech (UV) will be explained later in connection with the structure of various components.

In the speech encoder of FIG. 3, a specified example of a voiced/unvoiced (V/UV) discrimination unit 115 is now explained.

This V/UV discrimination unit 115 carries out the V/UV discrimination of the frame in subject based on the frame averaged energy lev of the input speech signal, normalized autocorrelation peak value rp, spectral similarity pos, number of zero-crossings nZero and the pitch lag pch.

That is, the V/UV discrimination unit 115 is fed with the frame averaged energy lev of the spectral envelope of the input speech signal, that is the frame-averaged rms or an equivalent value lev, normalized autocorrelation peak value rp from the open-loop pitch search unit 141, the crossing count value nzero from the zero-crossing counter 142 and with the pitch lag pch as an optimum pitch from the zero-crossing counter 142, based on an output of the orthogonal transform circuit 145. The number of zero-crossings is the pitch period represented as the number of samples. The boundary position of the band-based results of V/UV decision similar to that in MBE is also used as a condition for V/UV decision of the frame. This is supplied to the V/UV decision unit 115 as the spectral similarity pos.

The condition for V/UV discrimination for the MBE, employing the results of band-based V/UV discrimination, is now explained.

The parameter or amplitude $|A_m|$ representing the magnitude of the m'th harmonics in the case of MBE may be represented by $$\therefore |A_m| = \sum_{j=a_m}^{b_m} |S(j)||E(j)| \Big/ \sum_{j=a_m}^{b_m} |E(j)|^2$$

In this equation, $|S(j)|$ is a spectrum obtained on DFTing LPC residuals, and $|E(j)|$ is the spectrum of the basic signal, specifically, a 256-point Hamming window, while $a_m$, $b_m$ are lower and upper limit values, represented by an index j, of the frequency corresponding to the m'th band corresponding in turn to the m'th harmonics. For band-based V/UV discrimination, a noise to signal ratio (NSR) is used. The NSR of the m'th band is represented by $$NSR = \frac{\sum_{j=a_m}^{b_m} \{|S(j) - |A_m||E(j)|\}^2}{\sum_{j=a_m}^{b_m} |S(j)|^2}$$

If the NSR value is larger than a pre-set threshold, such as 0.3, that is if an error is larger, it may be judged that approximation of $|S(j)|$ by $|A_m|$ $|(j)|$ in the band in subject is not good, that is that the excitation signal $|E(j)|$ is not appropriate as the base. Thus the band in subject is determined to be unvoiced (UV). If otherwise, it may be judged that approximation has been done fairly well and hence the band is determined to be voiced (V).

Meanwhile, since the number of bands split with the fundamental pitch frequency is varied in a range of approximately 8 to 63 depending on the pitch of the speech, the band-based number of the V/UV flags is also varied. Thus the results of V/UV decision are grouped (or degraded) in terms of a pre-set number of bands obtained on splitting a fixed frequency range. Specifically, a pre-set frequency range including the audible range is divided into for example 12 bands for each of which V/UV decision is made. Specifically, data specifyng not more than one division position or the boundary position between the voiced (V) area and the unvoiced (UV) area in all bands in the band-based V/UV decision data are used as the spectra similarity pos. The values that can be assumed by the spectra similarity pos is $1 \leqq pos \leqq 12$.

The input parameters supplied to the V/UV decision unit 115 are function-calculated for carrying out functional values representing the degree of likeliness to voiced speech (V). An illustrative example of the function is now explained.

First, the value of the function pLev(lev) is calculated based in the value lev of the frame averaged energy of the input speech signal. As this function pLev(lev), $$pLev(lev)=1.0/(1.0+\exp(-(lev-400.0)/100.0))$$

is used.

The value of function pR0r (rp) is then calculated based on the value of the normalized autocorrelation peak value rp ($0 \leqq rp \leqq 1.0$). An illustrative example of the function pR0r (rp) is $$pR0r(rp)=1.0/(1.0+\exp(-(rp-0.3)/0.06)).$$

The value of function pP0s(pos) is then calculated based on the value of the degree of likeliness pos ($1 \leqq pos \leqq 12$). An illustrative example of the function pP0s(pos) is $$pP0s(pos)=1.0/(1.0+\exp(-(pos-1.5)/0.8)).$$

The value of function pNZero(nZero) is then found based on the value of the number of zero-crossings nZero ($1 \leqq nZero \leqq 160$). An illustrative example of the function pNZero(nZero) is $$pNZero(nZero)=1.0/(1.0+\exp((nZero-70.0)/12.0)).$$

The value of function pPch(pch) is then found based on the value of the pitch lag pch ($20 \leqq pch \leqq 147$). An illustrative example of the function pPch(pch) is $$pPch(pch)=1.0/(1.0+\exp(-(pch-12.0)/2.5))\times 1.0/(1.0+\exp((pch-105.0)/6.0)).$$

Using the degree of likeliness to V for the parameters lev, rp, pos, nZero and pch, calculated by the above functions pLev(lev), pR0r(rp), pNZero(nZero) and pPch(pch), ultimate likeliness to V is calculated. In this case, the following two points need to be considered.

That is, as a first point, if the autocorrelation peak value is smaller but the frame averaged energy is very large, the speech should be deemed to be voiced (V). That is, weighted sum is taken for two parameters bearing strong complementary relation to each other. As a second point, parameters independently representing likeliness to V are processed by multiplication.

Therefore, the autocorrelation peak value and the frame averaged energy, bearing a complementary relation to each other, are summed by weighted addition, whilst other parameters are processed by multiplication. The function f (lev, rp, pos nZero, pch) representing ultimate degree of likeliness to V is calculated by $$f(lev, rp, pos\ nZero, pch)=((1.2pR0r(rp)+0.8pLev(lev))/2.0)\times pPos(pos)\times pNZero(nZero)\times pPch(pch).$$

It is noted that weighting parameters ($\alpha$=1.2, $\beta$=0.8) are empirically found values.

The V/UV decision is carried out by discriminating the value of the function $f$ with a pre-set threshold value. Specifically, if $f$ is ultimately not less than 0.5, the frame is voiced (V), whereas, if it is smaller than 0.5, the frame is unvoiced (UV).

Meanwhile, the above-mentioned function pR0r(rp) for finding the likeliness to V for the normalized autocorrelation peak value rp may be replaced by functions pR0r'(rp) approximating the function pR0r(rp), namely

| | |
|---|---|
| pROr'(rp) = 0.6x | $0 \leqq x \leqq 7/34$ |
| pROr'(rp) = 4.0 (x − 0.175) | $7/34 \leqq x \leqq 67/170$ |
| pROr'(rp) = 0.6x + 0.64 | $67/170 \leqq x \leqq 0.6$ |
| pROr'(rp) = 1 | $0.6 \leqq x \leqq 1.0$ |

In sum, the basic concept of the above-described V/UV decision resides in that the parameter x for V/UV decision, such as the above-mentioned input parameters lev, rp, pos, nZero or pch, are converted by sigmoid functions g(x) represented by $$g(x)=A/(1+\exp(-(x-b)/a))$$

where A, a and b are constants, and the parameters converted by this sigmoid function g(x) are used for V/UV decision.

If these input parameters lev, rp, pos nZero and pch are generalized such that n input parameters, where n is a natural number, are represented by $x_1, x_2, \ldots, x_n$, the degree of likeliness to V by these input parameters $x_k$, where k=1, 2, . . . , n, is represented by a function $g_k(x_k)$ and the ultimate likeliness to V is evaluated by $$f(x_1, x_2, \ldots, xn)=F(g_1(x_1), g_2(x_2), \ldots, g_n(x_n)).$$

As the function $g_k(x_k)$, where k=1, 2, . . . , n, an optional function having a range capable of assuming any values from $c_k$ to $d_k$, where $c_k$ and $d_k$ are constants such that $c_k<d_k$, may be used.

As the function $g_k(x_k)$, an optional function comprised of plural straight lines of different gradients having a range capable of assuming any values from $c_k$ to $d_k$, may also be used.

As the function $g_k(x_k)$, an optional continuous function capable of assuming any values from ck to dk may similarly be used.

Also, as the function $g_k(x_k)$, sigmoid functions represented by $$g_k(x_k)=A_k/(1+\exp(-(x_k-b_k)/a_k))$$

where k=1, 2, . . . , n and $A_k$, $a_k$ and $b_k$ are constants differing with the input parameter $x_k$, or combinations thereof by multiplication, may be used.

The sigmoid functions or combinations thereof by multiplication may be approximated by plural straight lines having different gradients.

The input parameters may be the frame averaged energy lev, normalized autocorrelation rp, spectral similarity pos, number of zero-crossings nZero and pitch lag pch of the input speech signals.

If the functions representing the degree of likeliness to V for the above-mentioned input parameters lev, rp, pos, nZero and pch are represented by pLev(lev), pR0(rp), pPos(pos), pNZero(nZero) and pPch(pch), respectively, the function f(lev, rp, pos nZero, pch) representing ultimate likeliness to V by these functions can be calculated by $$f(lev, rp, pos\ nZero, pch)=((\alpha pR0r(rp)+\beta pLev(lev))/(\alpha+\beta))\times pPos(pos)\times pNZero(nZero)\times pPch(pch)$$

where $\alpha$, $\beta$ are constants for appropriately weighting pR0r and pLev, respectively.

The value of the function f, obtained as described above, is discriminated using a pre-set threshold value for giving V/UV decision.

The manner in which the pitch detection is carried out using the high-reliability pitch information is now explained.

It is assumed that pitch detection is performed using the results of V/UV decision of the previous frame prevVUV, with the high-reliability pitch information rb1Pch as found by the above-described operations as a reference value.

In this case, there are the following four cases (i) to (iv) depending on the combination of the high-reliability pitch information rb1Pch and the results of V/UV decision of the previous frame prevVUV.

(i) prevVUV≠0 and rb1Pch≠0

Pitch detection is carried out by referring to the high-reliability pitch information. Since the directly previous frame is already found to be voiced (V), reference for pitch detection is had preferentially to the information of the directly previous frame.

(ii) prevVUV=0 and rb1Pch≠0

Since the directly previous frame is unvoiced (UV), its pitch cannot be used, so that pitch detection is carried out by having reference only to rb1Pch.

(iii) prevVUV=1 and rb1Pch=0

Since at least the directly previous frame is judged to be voiced (V), pitch detection is carried out using only its pitch.

(iv) prevVUV=0 and rb1Pch=0

Since the directly previous frame is judged to be unvoiced (UV), pitch detection is carried out by having reference to the next oncoming future frame pitch.

The above-described four cases are specifically explained with reference to the flowcharts of FIGS. 7 and 8.

Figure 7:
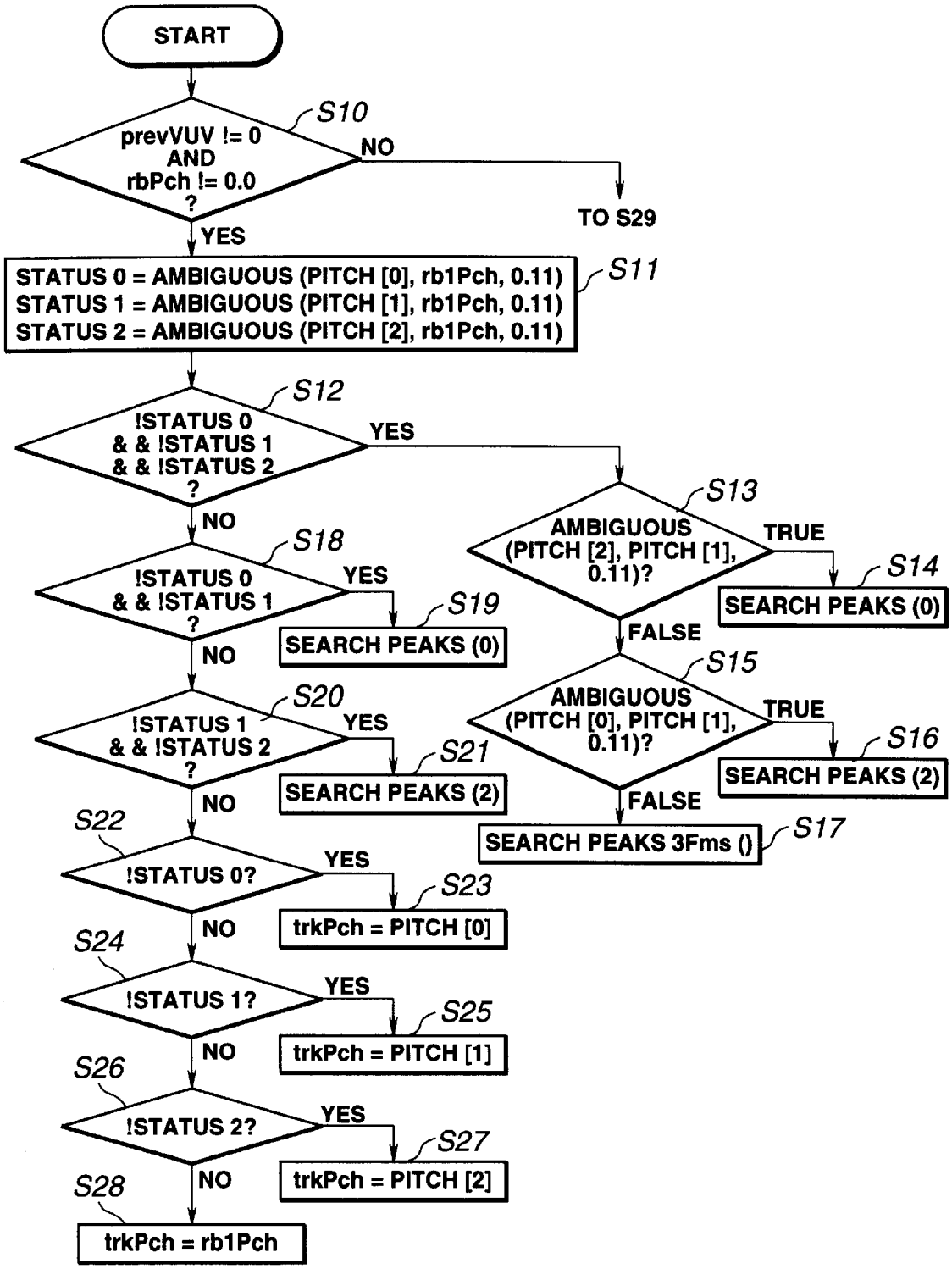
FIG. 7 is a flowchart showing a typical sequence of operations for pitch detection in the structure of FIG. 3.
Figure 8:
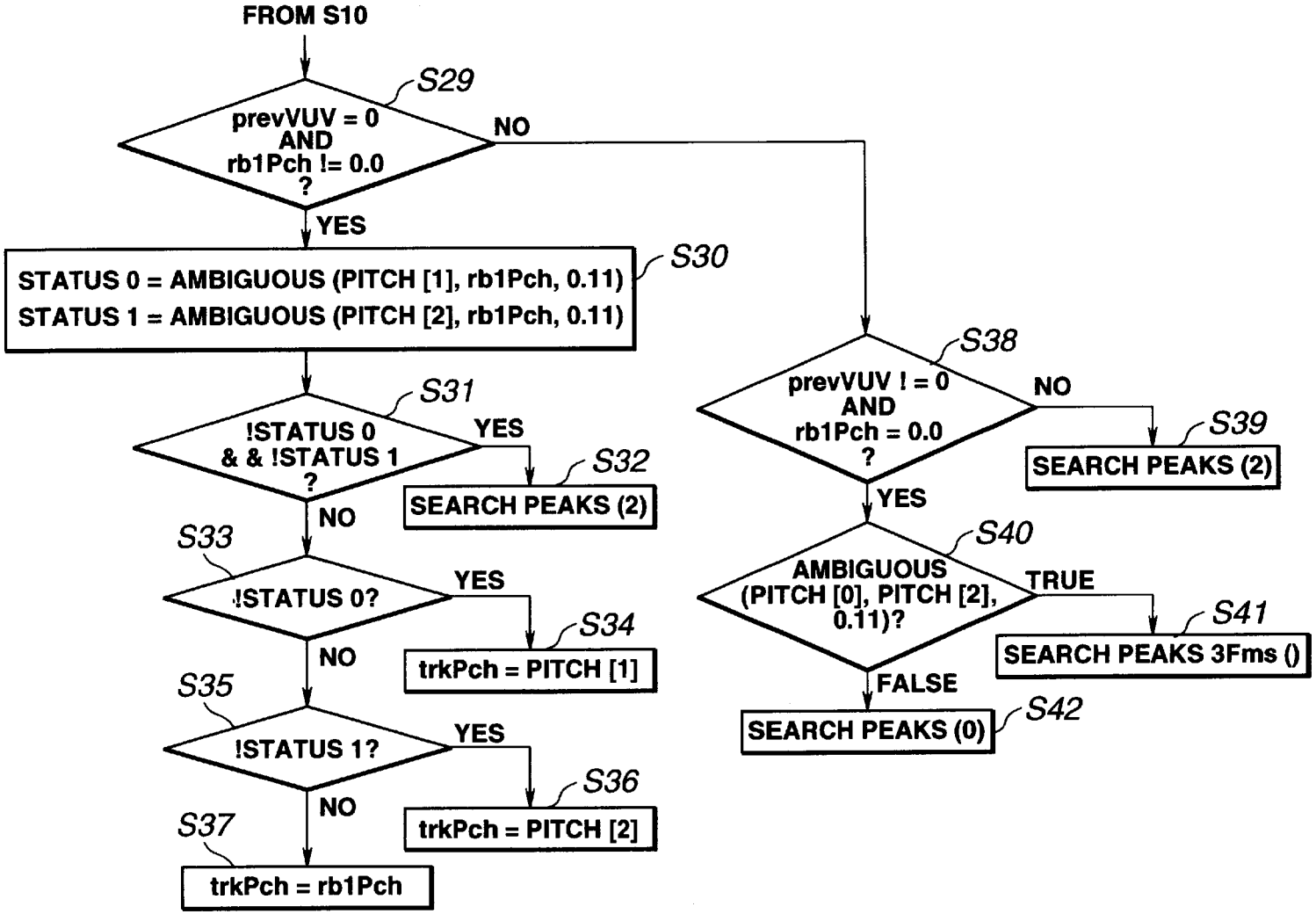
FIG. 8 is a flowchart showing a typical sequence of operations for pitch detection in the structure of FIG. 3.

In FIGS. 7 and 8, ! denotes negation, && denotes 'and' and trkPch denotes the pitch which is an ultimately detected pitch.

SearchPeaks(frm) (frm={0, 2}) is such a function which is pitch[1] if rp[1]≧rp[frm] or if rp[1]>0.7 and which otherwise has as its value crntLag(n) first satisfying 0.81× pitch[frm]<crntLag(n)<1.2×pitch[frm] on sequentially searching crntLag(n) for n=0, 1, . . .

Similarly, SearchPeaks3Frms is such a function which is equal to pitch[1] if, on comparing rp[0], rp[1] and rp[2], rp[1] is larger than rp[0] or rp[2] or larger than 0.7 and which otherwise performs the same operation as the above-mentioned SearchPeaks(frm) using, as a reference frame, a frame having larger values of the autocorrelation peak values rp[0] or rp[2].

First, at step S10, it is judged whether or not the condition that 'the results of V/UV decision of the previous frame prevVUV are not 0, while the high-reliability pitch information rb1Pch is not 0.0' is met. If this condition is not met, processing transfers to step S29 as later explained. If this condition is met, processing transfers to step S11.

At step S11, status0=Ambiguous(pitch[0], rb1Pch, 0.11)

status1=Ambiguous(pitch[1], rb1Pch, 0.11)

status2=Ambiguous(pitch[2], rb1Pch, 0.11)

are defined.

At step S12, it is judged whether the condition 'none of status0, status 1 nor status2 holds' is met. If this condition is met, processing transfers to step S13 and, if otherwise to step S18.

At step S18, it is judged whether the condition 'neither status0 not status2 holds' is met. If this condition is met, processing transfers to step S19 to adopt SearchPeaks(0) as pitch and, if otherwise, processing transfers to step S20.

At step S20, it is judged whether the condition 'neither status1 nor status2 holds' is met. If this condition is met, processing transfers to step S21 to adopt SearchPeaks(2) as pitch and, if otherwise, processing transfers to step S22.

At step S22, it is judged whether the condition 'status0 does not hold' is met. If this condition is met, trkPch=pitch [0] is set as pitch and, if otherwise, processing transfers to step S24.

At step S24, it is judged whether the condition 'status does not hold' is met. If this condition is met, trkPch=pitch [1] is set as pitch and, if otherwise, processing transfers to step S26.

At step S26, it is judged whether the condition 'status2 does not hold' is met. If this condition is met, trkpch=pitch [2] is set as pitch and, if otherwise, processing transfers to step S28 to adopt trkpch=rb1Pch as pitch.

At the above-mentioned step S13, it is judged whether the function Ambiguous(pitch[2], pitch[1], 0.11) is true or false. If this function is true, processing transfers to step S14 to adopt SearchPeaks(0) as pitch. If the function is false, processing transfers to step S15 to adopt SearchPeaks3frms( ) as pitch.

At step S15, it is judged whether the function Ambiguous (pitch[0], pitch[1], 0.11) is true or false. If this function is true, processing transfers to step S16 to adopt SearchPeaks (2) as pitch. If the function is false, processing transfers to step S17 to adopt SearchPeaks3frms( ) as pitch.

Then, at the above-mentioned step S29, it is judged whether th condition 'the previous frame is UV and the high-reliability pitch information is 0.0' is met. If this condition is not met, processing transfers to step S38 and, if otherwise, to step S30.

At step S30, status0=Ambiguous(pitch[0], rb1Pch, 0.11)

status1=Ambiguous(pitch[2], rb1Pch, 0.11)

are defined.

At step S31, it is judged whether the condition 'neither status0 nor status1 holds' is met. If this condition is met, processing transfers to step S32 to adopt SearchPeaks(2) as pitch and, if otherwise, processing transfers to step S33.

At step S33, it is judged whether the condition 'status0 does not hold' is met. If this condition is met, trkPch=pitch [1] is set as pitch and, if otherwise, processing transfers to step S35.

At step S35, it is judged whether the condition 'status1 does not hold' is met. If this condition is met, trkPch=pitch [2] is set as pitch and, if otherwise, processing transfers to step S37 to adopt trkPch=rblPch as pitch.

At the above-mentioned step S38, it is judged whether or not the condition 'the previous frame is not UV and the high-reliability pitch information is 0.0' is met. If this condition is not met, processing transfers to step S40 to adopt SearchPeaks(2) as pitch. If the condition is met, processing transfers to step S40.

At step S40, it is judged whether the function Ambiguous (pitch[0], pitch[2], 0.11) is true or false. If this function is false, processing transfers to step S41 to adopt SearchPeaks3Frms( ) as pitch. If the function is true, processing transfers to step S42 to adopt Search(0) as pitch.

The above sequence of operations realizes pitch detection employing the high-reliability pitch information.

In the above illustrative example, pitch detection is realized using the results of V/UV detection along with the high-reliability pitch information. Another illustrative example of using only the results of V/UV detection for usual pitch detection is hereinafter explained.

For using the results of V/UV detection of encoding units other than the current encoding unit for pitch detection, V/UV decision is given only from three parameters of normalized autocorrelation peak value r'(n)($0 \leqq r'(n) \leqq 1.0$), number of zero-crossings nZero ($0 \leqq nZero < 160$) and frame averaged level lev.

For these three parameters, the degrees of likeliness to V are calculated by the following equations:

$$pRp(rp)=1.0/(1.0+\exp(-(rp-0.3/0.06))) \quad (1)$$

$$pNZero(nZero)=1.0/\{\exp((nZero-70.0)/12.0)\} \quad (2)$$

$$pLev(lev)=1.0/\{1.0+\exp(-(lev-400.0/100.0))\} \quad (3)$$

Using the equations (1) to (3), the degree of ultimate likeliness to V is defined by the following equation:

$$f(nZero, rp, lev)=pNZero(nZero)\times\{1.2\times pRp(rp)+0.8\times pLev(lev)\}/2.0 \quad (4)$$

If f is not less than 0.5, the frame is judged to be voiced (V) and, if f is smaller than 0.5, the frame is judged to be unvoiced (UV).

Figure 9:
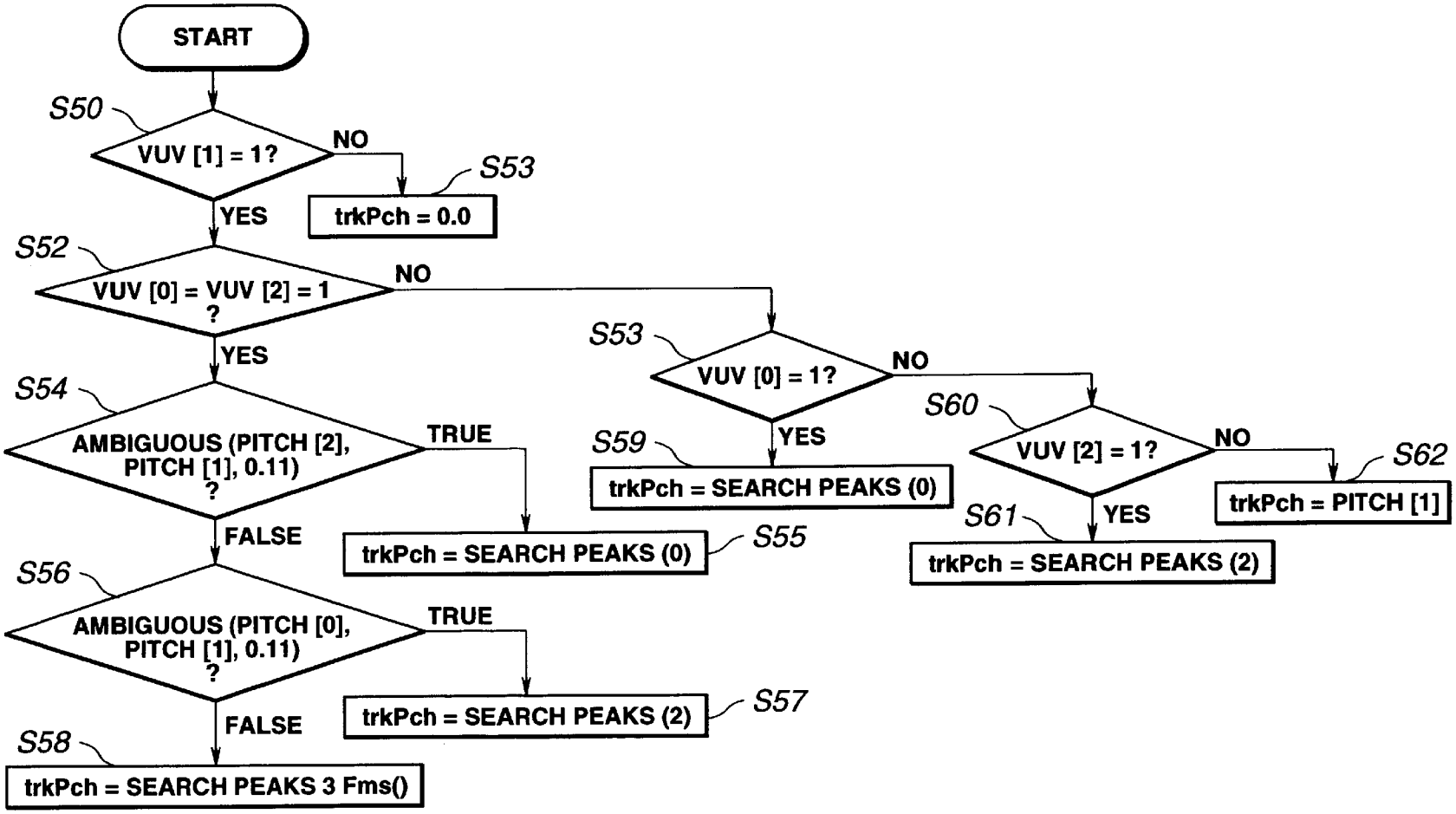
FIG. 9 is a flowchart showing another typical sequence of operations for pitch detection in the structure of FIG. 3.

An illustrative sequence of operations of pitch detection employing only the results of V/UV decision is explained by referring to the flowchart of FIG. 9.

It is noted that prevVUV is the result of V/UV decision of the previous frame. The values of prevVUV of *1* and *0* indicate V and UV, respectively.

First, at step S50, V/UV decision is made of the current frame for deciding whether 'the result of decision prevVUV has a value of 1' that is whether the frame is voiced. If the frame is judged to be UV at step S50, processing transfers to step S51 to adopt trkPch=0.0 as pitch. On the other hand, if the result of step S50 is V, processing transfers to step S52.

At step s52, it is judged whether the results of V/UV decision of the past and future frames are both 1', that is whether or not both frames are V. If the result is negative, processing transfers to step S53 as later explained. If both frames are V, processing transfers to step S54.

At step S54, it is judged whether or not the function Ambiguous(pitch[2], pitch[1], 0.11) specifying the relation between two pitches pitch[2], pitch[1] and a constant 0.11 is true or false. If the function is true, processing transfers to step S55 to set trkPch=SearchPeaks(0). That is if rp[1]≧rp [)] or rp[rp1]>0.7, pitch [1] holds. If otherwise crntLag(n) is searched in the order of n=0, 1, 2, . . . and crntLag(n) satisfying 0.81×pitch[0]<crntLag(n)<1.2×pitch[0] is set. If the function Ambiguous(pitch[0], pitch[1], 0.11 is false, processing transfers to step S56.

At step S56, it is judged whether or not the function Ambiguous(pitch[0], pitch[1], 0.11) specifying the relation between two pitches pitch[0], pitch[1] and a constant 0. 11 is true or false. If the function is true, processing transfers to step S57 to set trkPch=SearchPeaks(2). If the function Ambiguous(pitch[0], pitch[1], 0.11) is false, processing transfers to step S58 (trkPch=SearchPeaks3Frm( ) to compare rp(0), rp(1) and rp(2). If rp[1] is not less than rp[0] or rp[2] or larger than 0.7, pitch[1] is used. If otherwise, the same operation as SearchPeaks(frm) as described above is performed using a frame having larger values of the autocorrelation peak values rp[0] and rp[2] as a reference frame.

At the above-mentioned step S53, it is judged whether 'the result of V/UV decision of the past frame is 1', that is whether or not the frame is V. If the past frame is V, processing transfers to step S59 to set trkPch=SearchPeaks (0) as pitch. If the past frame is UV, processing transfers to step S60.

At step S60, it is judged whether 'the result of V/UV decision for a future frame is 1', that is if the future frame is V. If the result is affirmative, processing transfers to step S61 to accept trkPch=SearchPeaks(0) as pitch. If the future frame is UV, processing transfers to step S62 where the pitch of the current frame pitch[1] is accepted as pitch for trkpch.

Figure 10A:
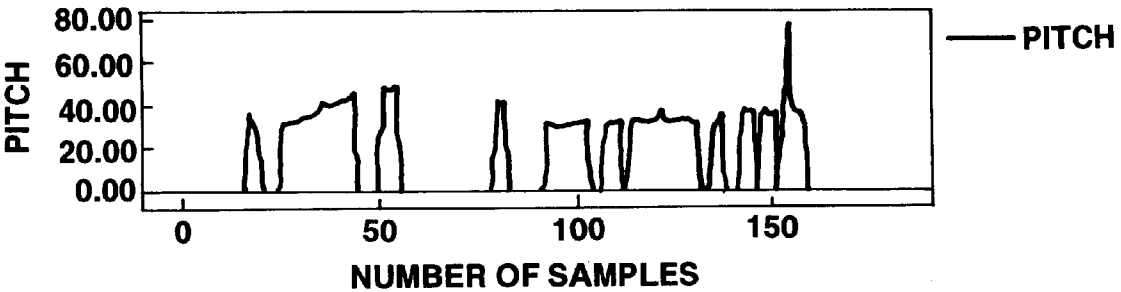
FIG. 10 shows the results of pitch detection in the structure of FIG. 3.
Figure 10B:
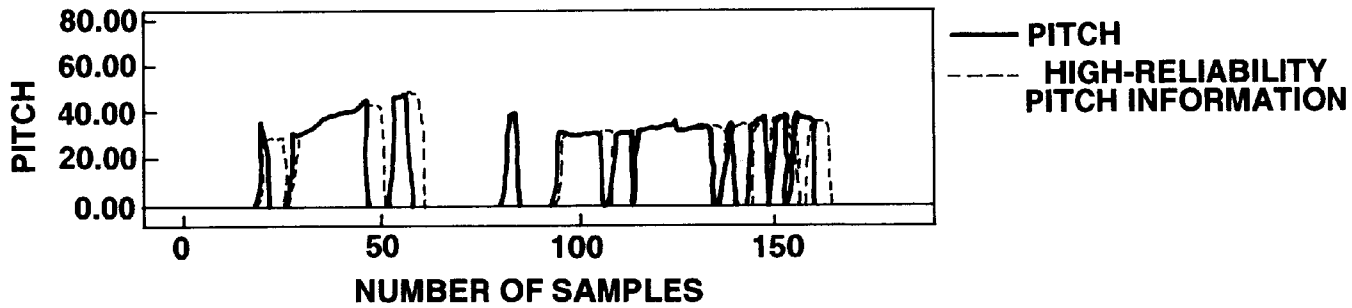
Figure 10C:
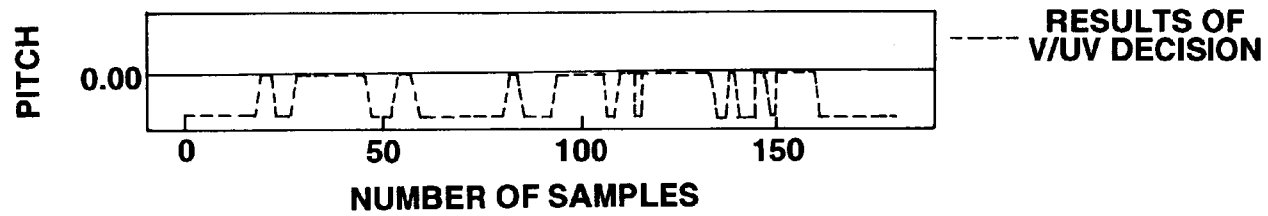

FIGS. 10A to 10C show the results of application of the above-described results of V/UV decision to pitch detection of speech samples. In FIGS. 10A to 10C, the abscissa and the ordinate denote the number of frames and the pitch, respectively.

FIG. 10A shows the pitch trajectory as detected by a conventional pitch detection method, while FIG. 10B shows the pitch trajectory as detected by the pitch detection method of the present invention in which both the high-reliability pitch information and the results of V/UV decision shown in FIG. 10C are used.

It is seen from these results that the pitch detection method of the present invention sets the high-reliability pitch information for a portion of the speech signal found to be voiced (V) and holds the value for a pre-set time, herein for 5 frames. The result is that there is produced no mistaken pitch detection in the abruptly changing pitch portion as seen at the 150th sample of FIG. 10A.

Figure 11:
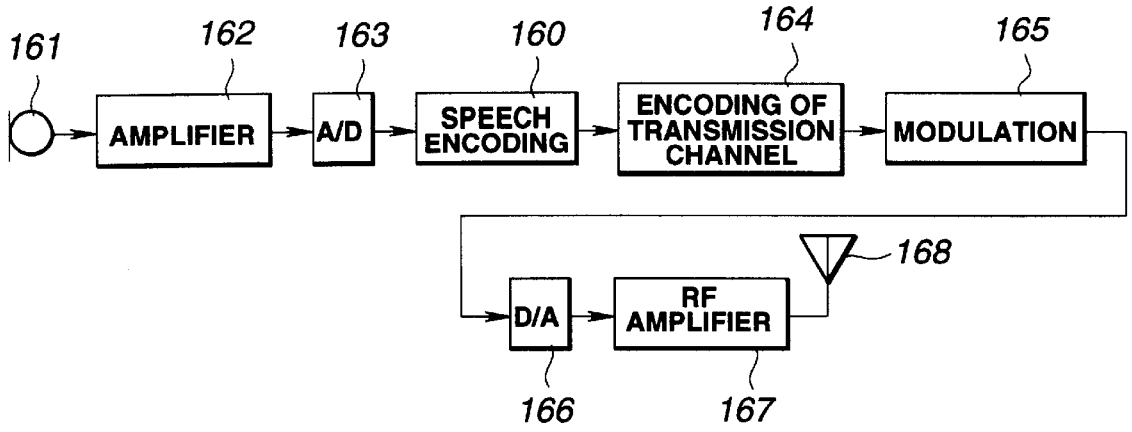
FIG. 11 is a block diagram showing the structure of the transmitting side of a portable terminal employing the speech signal encoding device embodying the present invention.
Figure 12:
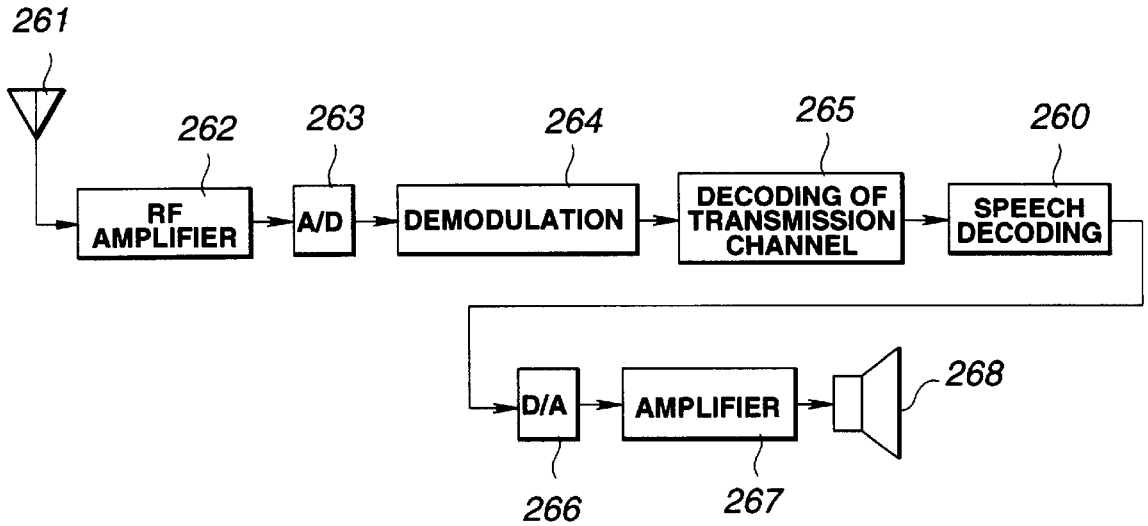
FIG. 12 is a block diagram showing the structure of the receiving side of a portable terminal employing the speech signal decoding device embodying the present invention.

The above-described signal encoding and signal decoding device may be used as a speech codec employed in, for example, a portable communication terminal or a portable telephone set shown in FIGS. 11 and 12.

FIG. 11 shows a transmitting side of a portable terminal employing a speech encoding unit 160 configured as shown in FIGS. 1 and 3. The speech signals collected by a microphone 161 of FIG. 11 are amplified by an amplifier 162 and converted by an analog/digital (A/D) converter 163 into digital signals which are sent to the speech hencoding unit 160 configured as shown in FIGS. 1 and 3. The digital signals from the A/D converter 163 are supplied to the input terminal 101. The speech encoding unit 160 performs encoding as explained in connection with FIGS. 1 and 3. Output signals of output terminals of FIGS. 1 and 3 are sent as output signals of the speech encoding unit 160 to a transmission channel encoding unit 164 which then performs channel coding on the supplied signals. Output signals of the transmission channel encoding unit 164 are sent to a modulation circuit 165 for modulation and thence supplied to an antenna 168 via a digital/analog (D/A) converter 166 and an RF amplifier 167.

FIG. 12 shows a reception side of the portable terminal employing a speech hdecoding unit 260 configured as shown in FIG. 2. The speech signals received by the antenna 261 of FIG. 12 are amplified an RF amplifier 262 and sent via an analog/digital (A/D) converter 263 to a demodulation circuit 264, from which demodulated signal are hsent to a transmission channel decoding unit 265. An output signal of the decoding unit 265 is supplied to a speech decoding unit 260 configured as shown in FIG. 2. The speech decoding unit 260 decodes the signals in a manner as explained in connection with FIG. 2. An output signal at an output terminal 201 of FIG. 2 is sent as a signal of the speech decoding unit 260 to a digital/analog (D/A) converter 266. An analog speech signal from the D/A converter 266 is sent to a speaker 268.

The present invention is not limited to the above-described embodiments. Although the structure of the speech analysis side (encoding side) of FIGS. 1 and 3 or that of the speech synthesis side (decoder side) of FIG. 2 is described as hardware, it may be implemented by a software program using a digital signal processor (DSP). It should also be noted that the scope of the present invention is applied not only to the transmission or recording and/or reproduction but also to a variety of other fields such as pitch or speed conversion, speech synthesis by rule or noise suppression.

What is claimed is:

1. A pitch detection method for detecting a pitch corresponding to a fundamental period of an input speech signal using an open-loop pitch search, the method comprising the steps of:

detecting an approximate pitch from the input speech signal under a pre-set pitch detecting condition;

setting a high-reliability pitch by evaluating a reliability of the pitch based on the approximate pitch detected by the step of detecting, a speech level of the input speech signal, and an autocorrelation peak value of the input speech signal; and determining the pitch using said open-loop pitch search by evaluating the high-reliability pitch and the approximate pitch, wherein the pitch is an improved estimation from the high-reliability pitch and the approximate pitch, wherein when the high-reliability pitch is maintained for a pre-set time the high-reliability pitch is updated if the high-reliability pitch is within a pre-set range to a next pitch detected in a next encoding unit, said preset-range indicates whether the high-reliability pitch and the next pitch are one of substantially twice, thrice, one-half, and one-third relative to each other, and the high-reliability pitch is discarded if the high-reliability pitch is not updated within the preset time.

2. The pitch detection method as claimed in claim 1, wherein the step of setting the high-reliability pitch uses a candidate value of the high-reliability pitch for setting the high-reliability pitch, updates the candidate value of the high-reliability pitch when a pitch within a pre-set range of the high-reliability pitch is detected, discards the candidate value of the high-reliability pitch when the pitch is not within the pre-set range, and resets the candidate value of the high-reliability pitch when the candidate value is maintained for a pre-set time.

3. The pitch detection method as claimed in claim 1, wherein the determined pitch is used as an input of a high precision pitch search.

4. A speech signal encoding method in which an input speech signal is divided in terms of a pre-set encoding unit and encoded according to the encoding unit, the method comprising the steps of:

judging the input speech signal to be voiced or unvoiced;

detecting an approximate pitch from the input speech signal under a pre-set pitch detection condition;

setting a high-reliability pitch by evaluating a reliability of the pitch based on the approximate pitch detected by the step of detecting, a speech level of the input speech signal, and an autocorrelation peak value of the input speech signal;

determining the pitch using an open-loop pitch search by evaluating the high-reliability pitch and the approximate pitch, wherein the pitch is an improved estimation from the high-reliability pitch and the approximate pitch;

finding short-term prediction residuals of the input speech signal by predictive encoding; and performing sinusoidal analytic encoding on the short-term prediction residuals, wherein when the high-reliability pitch is maintained for a pre-set time, the high-reliability pitch is updated, if the high-reliability pitch is within a pre-set range, to a next pitch detected in a next encoding unit, said preset range indicates whether the high-reliability pitch is one of substantially twice, thrice, one-half, and one-third relative to each other, and the high-reliability pitch is discarded if the high-reliability pitch is not updated within the preset time.

5. A speech signal encoding apparatus in which an input speech signal is divided in terms of a pre-set encoding unit and encoded according to the encoding unit, comprising:

predictive encoding means for finding short-term prediction residuals of the input speech signal;

means for judging the input speech signal to be voiced or unvoiced;

means for detecting an approximate pitch from the input speech signal;

means for setting a high-reliability pitch by evaluating a reliability of the pitch based on the approximate pitch, a speech level of the input speech signal, and an autocorrelation peak value of the input speech signal;

means for determining the pitch using an open-loop pitch search by evaluating the high-reliability pitch and the approximate pitch, wherein the pitch is an improved estimation from the high-reliability pitch and the approximate pitch;

sinusoidal analytic encoding means producing an encoded output when the input speech signal is found to be voiced by the means for judging; and code excitation linear predictive coding means producing an encoded output when the input speech signal is found to be unvoiced by the means for judging, wherein when the high-reliability pitch is maintained for a pre-set time, the high-reliability pitch is updated, if the high-reliability pitch is within a pre-set range, to a next pitch in a next encoding unit, said pre-set range indicates whether the high-reliability pitch and the next pitch are one of substantially twice, one-half, and one-third relative to one another, and the high-reliability pitch is discarded if the high-reliability pitch is not updated within the pre-set time.

* * * * *